US011189128B2

(12) United States Patent
Miura et al.

(10) Patent No.: US 11,189,128 B2
(45) Date of Patent: Nov. 30, 2021

(54) GAMING MACHINE, GAMING SYSTEM, DISPLAY METHOD AND PROGRAM

(71) Applicant: Konami Gaming, Inc., Las Vegas, NV (US)

(72) Inventors: Norikazu Miura, Zama (JP); Shinnosuke Hiratsuka, Zama (JP)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/586,415

(22) Filed: Sep. 27, 2019

(65) Prior Publication Data

US 2020/0111296 A1 Apr. 9, 2020

(30) Foreign Application Priority Data

Oct. 5, 2018 (JP) ..... JP2018-190139

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/34; A63F 2300/6063
USPC ..... 463/31
See application file for complete search history.

(56) References Cited

U.S. PATENT DOCUMENTS

| | | | | |
|---|---|---|---|---|
| 7,364,505 | B2 * | 4/2008 | Mattice | G07F 17/32 273/138.1 |
| 9,192,857 | B2 | 11/2015 | Decker | |
| 2005/0054440 | A1 * | 3/2005 | Anderson | G07F 17/32 463/30 |
| 2005/0054442 | A1 * | 3/2005 | Anderson | G07F 17/32 463/35 |
| 2008/0009347 | A1 * | 1/2008 | Radek | G11B 27/3027 463/35 |
| 2015/0031454 | A1 * | 1/2015 | Decker | A63F 13/60 463/35 |
| 2016/0063809 | A1 * | 3/2016 | Decker | G07F 17/3223 463/16 |

* cited by examiner

*Primary Examiner* — Allen Chan
(74) *Attorney, Agent, or Firm* — Howard & Howard Attorneys PLLC

(57) ABSTRACT

A technique of synchronizing a timing to display an event in a game with a beat of a sound is provided. A gaming machine includes a display, a speaker, a storage device that stores tempo data including beat information of the entire BGM and BGM sound data, and a controller connected to the display, the speaker, and the storage device. The controller starts a display of a progression of a game in the display while causing the speaker to output the BGM on the basis of the BGM sound data, determines a timing at which an event is displayed on the display on the basis of the tempo data, dynamically configures animation data so that the event is displayed at the determined timing, and causes the dynamically configured animation data to be displayed on the display.

20 Claims, 15 Drawing Sheets

104

1041

1040

1042

| HOUR: MINUTE: SECOND: MILLISECOND | BAR: BEAT: TICK | SETTING S1 | SETTING S2 | SETTING S3 |
|---|---|---|---|---|
| 00:00:00:000 | 00001:01:000 | | 100 | 90 |
| 00:00:00:250 | 00001:01:240 | | 100 | 90 |
| ... | ... | | | |
| 00:00:06:000 | 00004:01:000 | | 100 | 90 |
| 00:00:06:250 | 00004:01:240 | | 100 | 90 |
| 00:00:06:500 | 00004:02:000 | [ | | |
| ... | ... | | | |
| 00:00:48:000 | 00025:01:000 | | 100 | 90 |
| 00:00:48:250 | 00025:01:240 | | 100 | 90 |
| 00:00:48:500 | 00025:02:000 | ] | | |

FIG. 8

104

1042

| TOTAL OF NUMBER OF BEATS | TIMING INFORMATION OF LOOP START POSITION (msec) | COUNT OF ACCUMULATED BEATS OF LOOP START POSITION | TIMING INFORMATION OF BGM END POSITION (msec) |
|---|---|---|---|
| 98 | 6750 | 14 | 48750 |

FIG. 10

GAMING MACHINE, GAMING SYSTEM, DISPLAY METHOD AND PROGRAM

CROSS-REFERENCE TO RELATED APPLICATION

This application claims priority to Japanese Patent Application No. 2018-190139, filed Oct. 5, 2018, the disclosure of which is hereby incorporated by reference in its entirety.

TECHNICAL FIELD

Embodiments of the present disclosure relate to a gaming machine, a control method, and a program.

BACKGROUND ART

Patent Literature 1 discloses a gaming machine that reproduces an audio file while a game is being provided. The gaming machine starts reproduction of the audio file and time measurement by a timer as the game starts, and predicts an on-beat timing by comparing beat data of the audio file being reproduced with a value of the timer. If the occurrence of an event in the game is recognized, the gaming machine determines an audio file to be used in the event, and reproduces the audio file to be used in the event at the timing that the audio file being reproduced is predicted to become an on-beat. Accordingly, the timing at which the audio file used in the event is reproduced is synchronized with the beat of the audio file being reproduced.

CITATION LIST

Patent Literature

Patent Literature 1: U.S. Pat. No. 9,192,857

SUMMARY OF INVENTION

Technical Problem

In the gaming machine disclosed in Patent Literature 1, the reproduction start of the audio file used in the event in the game is synchronized with the beat of the audio file being reproduced, but a timing at which the event in the game is displayed on the display is not considered. For this reason, the timing at which the event in the game is displayed on the display is unable to be synchronized with the beat of the audio file being reproduced. Further, there may be a time lag between the timing at which the event in the game is displayed and the timing at which the audio file used in the event is reproduced. Due to these problems, the player who plays the games in the gaming machines may feel uncomfortable.

The present disclosure provides a technique of synchronizing a timing to display an event in a game with a beat of a sound.

Solution to Problem

In one aspect of the present disclosure, a gaming machine is provided. The gaming machine includes a display, a speaker, a storage device, and a controller. The display displays a progression of a game including at least one event. The speaker outputs a sound of the game. The storage device stores tempo data including beat information of the entire background music (BGM) and sound data of the BGM. The controller is connected to the display, the speaker, and the storage device. The controller starts the display of the progression of the game in the display while causing the speaker to output the BGM on the basis of the sound data of the BGM stored in the storage device. The controller determines a timing at which the event is displayed on the display on the basis of the tempo data of the BGM. The controller dynamically configures animation data so that the event is displayed at the determined timing. The controller causes the dynamically configured animation data to be displayed on the display.

According to the gaming machine according to one aspect of the present disclosure, the BGM is output from the speaker in accordance with the player's operation, and the display of the progression of the game is started on the display. The timing to display the event on the display is determined on the basis of the tempo data of the BGM, and the animation data dynamically configured so that the event is displayed at the determined timing is displayed on the display. Since the display timing of the event is determined on the basis of the tempo data of the BGM as described above, the display timing of the event can be synchronized with the beat of the BGM. Accordingly, the gaming machine can synchronize the timing to display the event in the game with the beat of the sound.

In one embodiment, the gaming machine may further include an operation unit that receives a player's operation. The controller in this case may determine a timing at which the event is displayed on the display on the basis of a timing when the player operates the operation unit and the tempo data of the BGM. According to this configuration, the screen display can be synchronized with the beat of the BGM even in the event that occurs in response to the player's operation and has the timing which is not uniquely determined.

In one embodiment, the controller may determine content of the event randomly. According to this configuration, the screen display can be synchronized with the beat of the BGM even in the event that occurs randomly and has a timing which is not uniquely determined.

In one embodiment, the storage device may store event sound data, and the controller may cause the speaker to output a sound related to the event sound data stored in the storage device at the determined timing. According to this configuration, the display timing of the event can be synchronized with the event sound.

In one embodiment, the storage device may store a rhythm pattern defining a rhythm for sequentially displaying a plurality of events, and the controller may determine timings at which the plurality of events are displayed on the display on the basis of the tempo data and the rhythm pattern, dynamically configure animation data so that the plurality of events are sequentially displayed at the determined timings, and cause the display to display the dynamically configured animation data. According to this configuration, since the timings to display the plurality of events on the display are determined on the basis of the rhythm determined by the rhythm pattern and the beat of the BGM, the timings of the plurality of events can be synchronized with the beat of the BGM while getting into the rhythm determined by the rhythm pattern data. Accordingly, it is possible to help the player easily understand a connection between the plurality of events, and it is possible to give a wider range of event expressions using sound.

In one embodiment, the display may display a game screen including a plurality of cells arranged in a grid form, and the controller may determine symbols to be arranged in the plurality of cells randomly and performs winning determination in accordance with a combination of the symbols displayed on the display. According to this configuration, the display timing of the event can be synchronized with the beat of the BGM while the slot game is being provided.

In one embodiment, the display may display a game screen including a reel corresponding to a row of a plurality of cells arranged in a grid form, and the controller may configure animation data for spinning and stopping the reel using the spin and stop of the reel as the event. According to this configuration, the timings of the reel spin and stop operations can be synchronized with the beat of the BGM. As described above, since the timings of the spin and stop operations of the reel at which the player is most interested in are synchronized with the beat of the BGM, it is possible to provide the player with a rhythmic game progression and provide a comfortable game in which the BGM is combined with the operation of the reel.

In one embodiment, the gaming machine may further include an illumination to be lighted up, and the controller may cause the illumination to be lighted up at the determined timing. According to this configuration, the display timing of the event can be synchronized with the lighting-up of the illumination.

In another aspect of the present disclosure, a control method of a gaming machine is provided. The gaming machine includes a display, a speaker, a storage device, and a controller. The display displays a progression of a game including at least one event. The speaker outputs a sound of the game. The storage device stores tempo data including beat information of the entire BGM and sound data of the BGM. The controller is connected to the display, the speaker, and the storage device. The control method includes starting, by the controller, the display of the progression of the game in the display while causing the speaker to output the BGM on the basis of the sound data of the BGM stored in the storage device. The control method includes determining, by the controller, a timing at which the event is displayed on the display on the basis of the tempo data. The control method includes dynamically configuring, by the controller, animation data so that the event is displayed at the determined timing. The control method includes causing, by the controller, the dynamically configured animation data to be displayed on the display.

In another aspect of the present disclosure, a program of a gaming machine is provided. The gaming machine includes a display, a speaker, a storage device, and a controller. The display displays a progression of a game including at least one event. The speaker outputs a sound of the game. The storage device stores tempo data including beat information of the entire BGM and sound data of the BGM. The controller is connected to the display, the speaker, and the storage device. The program causes the controller to execute starting the display of the progression of the game in the display while causing the speaker to output the BGM on the basis of the sound data of the BGM stored in the storage device. The program causes the controller to execute determining a timing at which the event is displayed on the display on the basis of the tempo data. The program causes the controller to execute dynamically configuring animation data so that the event is displayed at the determined timing. The program causes the controller to execute causing the dynamically configured animation data to be displayed on the display.

Advantageous Effects of Invention

According to the gaming machine according to various aspects of the present disclosure, the timing to display the event in the game can be synchronized with the beat of the sound.

BRIEF DESCRIPTION OF DRAWINGS

FIG. 8 is an example of data that is an original form of BGM-related data.

FIG. 10 is an example of setting data associated with tempo data of FIG. 9.

DESCRIPTION OF EMBODIMENTS

Figure 1:
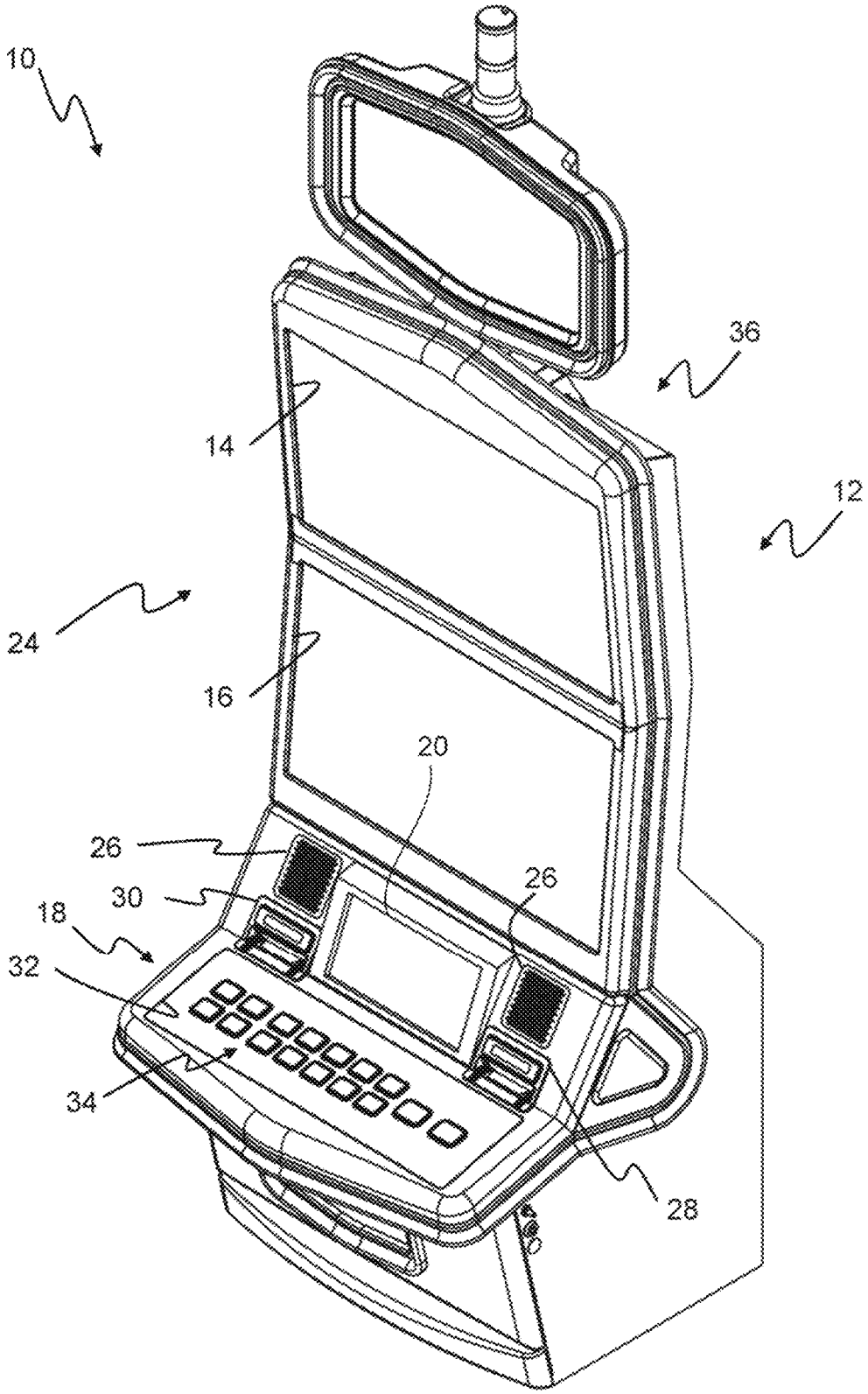
FIG. 1 is a perspective view illustrating an example of a gaming machine according to an embodiment.

Hereinafter, exemplary embodiments will be described in detail with reference to the accompanying drawings. In the drawings, the same or corresponding parts are denoted by the same reference numerals, and redundant description is omitted. The present disclosure relates to a gaming system, a gaming machine, a display method, and a gaming machine program as illustrated in the drawings and operation.

FIG. 1 is a perspective view illustrating an example of a gaming machine according to an embodiment. The gaming machine 10 illustrated in FIG. 1 can receive a predetermined game value from a player, generate a game result, and provide a dividend to the player in accordance with the game result and the paytable.

As illustrated in FIG. 1, the gaming machine 10 includes an upper display 14 (an example of a display), a lower display 16 (an example of a display), and a cabinet 12. The cabinet 12 also accommodates a controller 22 (see FIG. 2) that controls the components of the gaming machine 10.

The upper display 14 and the lower display 16 are flat panel display devices such as liquid crystal display devices and organic EL display devices. The upper display 14 and the lower display 16 provide a game screen to the player under the control of the controller 22. As will be described later, at least one of the upper display 14 and the lower display 16 displays a progression of the game including at least one event. An illumination 36 may be disposed around the upper display 14 and the lower display 16 to provide decorative lighting.

The cabinet 12 is arranged below the lower display 16. A control panel 18 is disposed in the cabinet 12 such that it protrudes forward in the front of the cabinet 12. The control panel 18 includes a player tracking unit 20, a speaker 26, a bill/ticket identification unit 28, a printer unit 30, and an operation unit 32.

The player tracking unit 20 includes a card reader that recognizes a player identification card, a display that presents data to the player, and a keypad that receives an input from the player. The player tracking unit 20 operates in cooperation with the controller 22 or an external system to read information recorded in the player identification card inserted into the card reader by the player and displays the information and/or information acquired by communicating with the external system on the display. Further, the input from the player is received by the keypad, a display is changed in accordance with the input, and communication with the external system is executed if necessary.

The speaker 26 is disposed on each of the right and left sides of the control panel 18. The speaker 26 provides a sound to the player under the control of the controller 22.

The bill/ticket identification unit 28 can be accommodated in the cabinet 12 in a state in which an insertion opening into which a bill/ticket is inserted is exposed. An identification unit that identifies a bill/ticket with various types of sensors is disposed in the insertion slot. A bill/ticket storage unit is disposed on an output port side of the identification unit. The bill/ticket identification unit 28 receives a bill/ticket (including a voucher and a coupon) that is a game value, identifies it as a game value, and notifies controller 22 of it.

The printer unit 30 can be accommodated in the cabinet 12 in a state in which the ticket output port from which the ticket is output is exposed. A printing unit that prints prescribed information on a printing paper is disposed in the ticket output port, and an accommodating unit that accommodates printing paper is disposed on a paper inlet side of the printing unit. The printer unit 30 prints information on paper under the control of the controller 22, and outputs the ticket from the gaming machine 10 in accordance with a credit payout process. When the output ticket is inserted into the bill/ticket identification unit 28 of another gaming machine, the paid-out credit can be used for the game play, or the output ticket can be converted into money by a kiosk terminal in a casino or a casino cage.

The operation unit 32 receives an operation from the player. The operation unit 32 includes a group of buttons 34 that receive various instructions from the player of the gaming machine 10. For example, the operation unit 32 may include a spin button and a group of setting buttons. The spin button receives an instruction to start an instance of a game (start spin of a reel). The group of setting buttons includes a group of bet buttons, a group of line designation buttons, a max bet button, a payout button, and the like. The group of bet buttons receives an instruction operation regarding a bet credit amount (a bet amount) from the player. The group of line designation buttons receives an instruction operation to designate a payline related to line determination to be described later from the player. The max bet button receives an instruction operation regarding a maximum credit amount that the player can bet on at one time. The payout button receives an instruction operation to instruct payout of a credit accumulated in the gaming machine 10.

Figure 2:
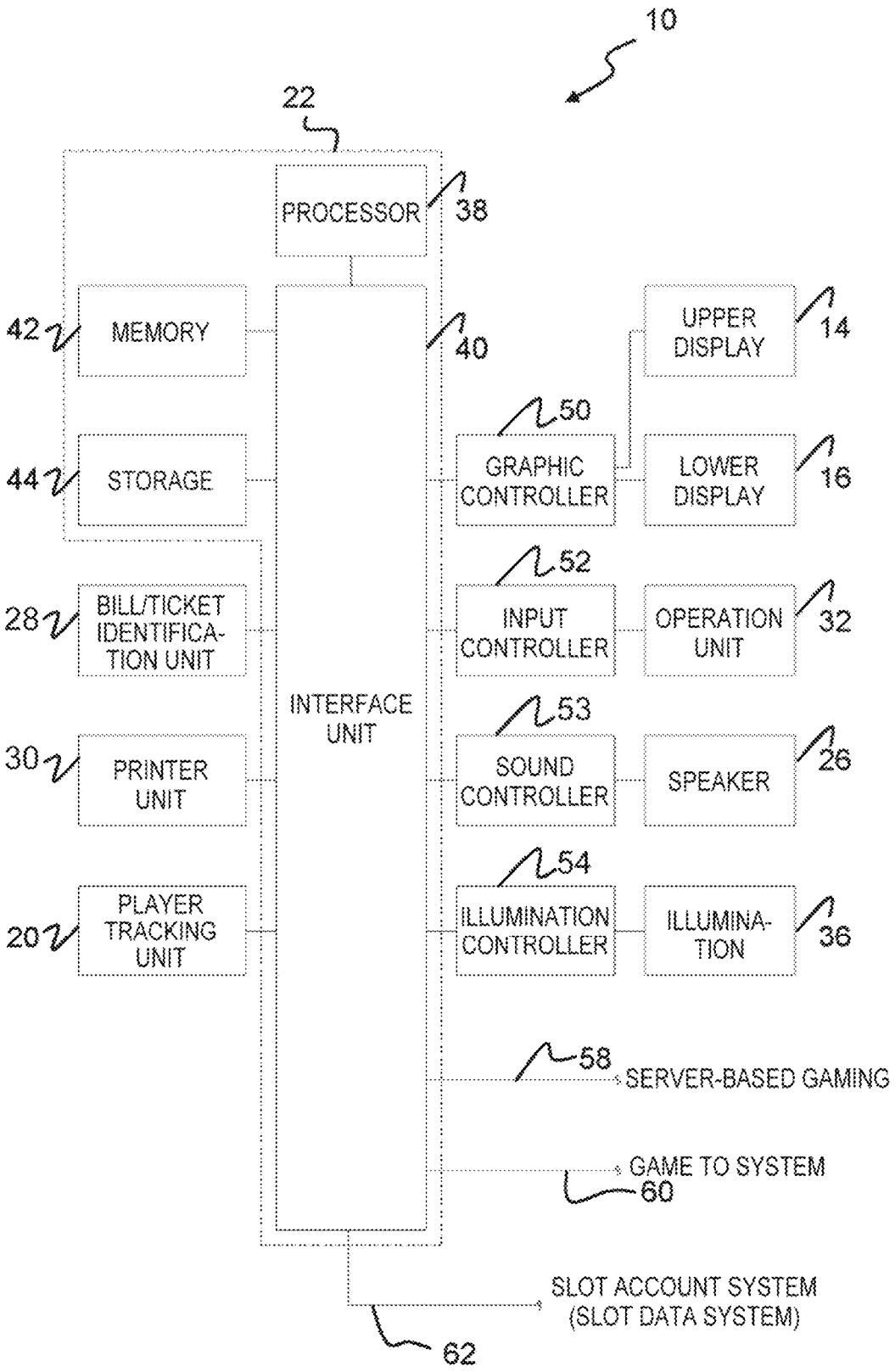
FIG. 2 is a block diagram illustrating an example of a configuration of a gaming machine.

FIG. 2 is a block diagram illustrating an example of a configuration of the gaming machine. The gaming machine 10 includes the controller 22. The controller 22 includes a processor 38 such as a CPU, an interface unit 40, a memory 42 (an example of a storage device), and a storage 44 (an example of a storage device). The controller 22 can be accommodated in the cabinet 12 as a control board. The controller 22 is configured to be able to communicate with each unit via the interface unit 40, and executes a program recorded in the memory 42 or the storage 44 of the processor 38 to control an operation of each unit such that the game is provided to the player.

The interface unit 40 includes a chip set that provides a communication function of the processor 38 such as a memory bus connected to the processor 38, various types of expansion buses, a serial interface, a USB interface, or an Ethernet (registered trademark) interfaces.

The memory 42 can be configured to include a RAM which is a volatile storage medium, a ROM which is a non-volatile storage medium, and an EEPROM which is a rewritable non-volatile storage medium. The storage 44 provides the controller 22 with a function of an external storage device, and a reading device such as a memory card which is a removable storage medium or a magneto-optical disk can be used, or a hard disk can be used.

The bill/ticket identification unit 28, the printer unit 30, the player tracking unit 20, a graphic controller 50, an input controller 52, a sound controller 53, and a illumination controller 54 are connected to the interface unit 40. The graphic controller 50, the input controller 52, the sound controller 53, and the illumination controller 54 can be accommodated in the cabinet 12 as a control board.

The controller 22 is connected to the upper display 14 and the lower display 16 via the graphic controller 50. The controller 22 is connected to the operation unit 32 via the input controller 52. The controller 22 is connected to the illumination 36 via the illumination controller 54.

The controller 22 executes a program stored in the memory 42 or the storage 44 to control each part such that the game is provided to the player. Here, for example, an operating system and a sub system program that provide the basic functions of the controller 22 and data may be stored in an EEPROM of the memory 42, and a program and data of an application that provides the game may be stored in the storage 44. With such a configuration, it is possible to easily change or update the game by replacing the storage 44. Further, the controller 22 may have a multi-processor configuration including a plurality of CPUs.

The respective blocks connected to the controller 22 will be described below. The bill/ticket identification unit 28 receives the bill/ticket through the insertion slot, and notifies the controller 22 of identification information corresponding to a bill type or a credit payout process. The controller 22 increases a credit amount usable in the game in accordance with the notification content. The printer unit 30 prints information corresponding to the credit payout process from the gaming machine 10 on the ticket under the control of the controller 22 that receives an operation of a payout button included in the operation unit 32, and outputs it.

The player tracking unit 20 operates in cooperation with the controller 22 and performs transmission and reception of player information with a casino management system. The graphic controller 50 controls the upper display 14 and the lower display 16 under the control of the controller 22 such that a display image including various types of graphic data is displayed. The sound controller 53 drives the speaker 26 under the control of the controller 22 and provides various types of sounds such as an announcement, a sound effect, and a BGM. The illumination controller 54 controls lighting of the illumination 36 under the control of the controller 22.

Figure 3:
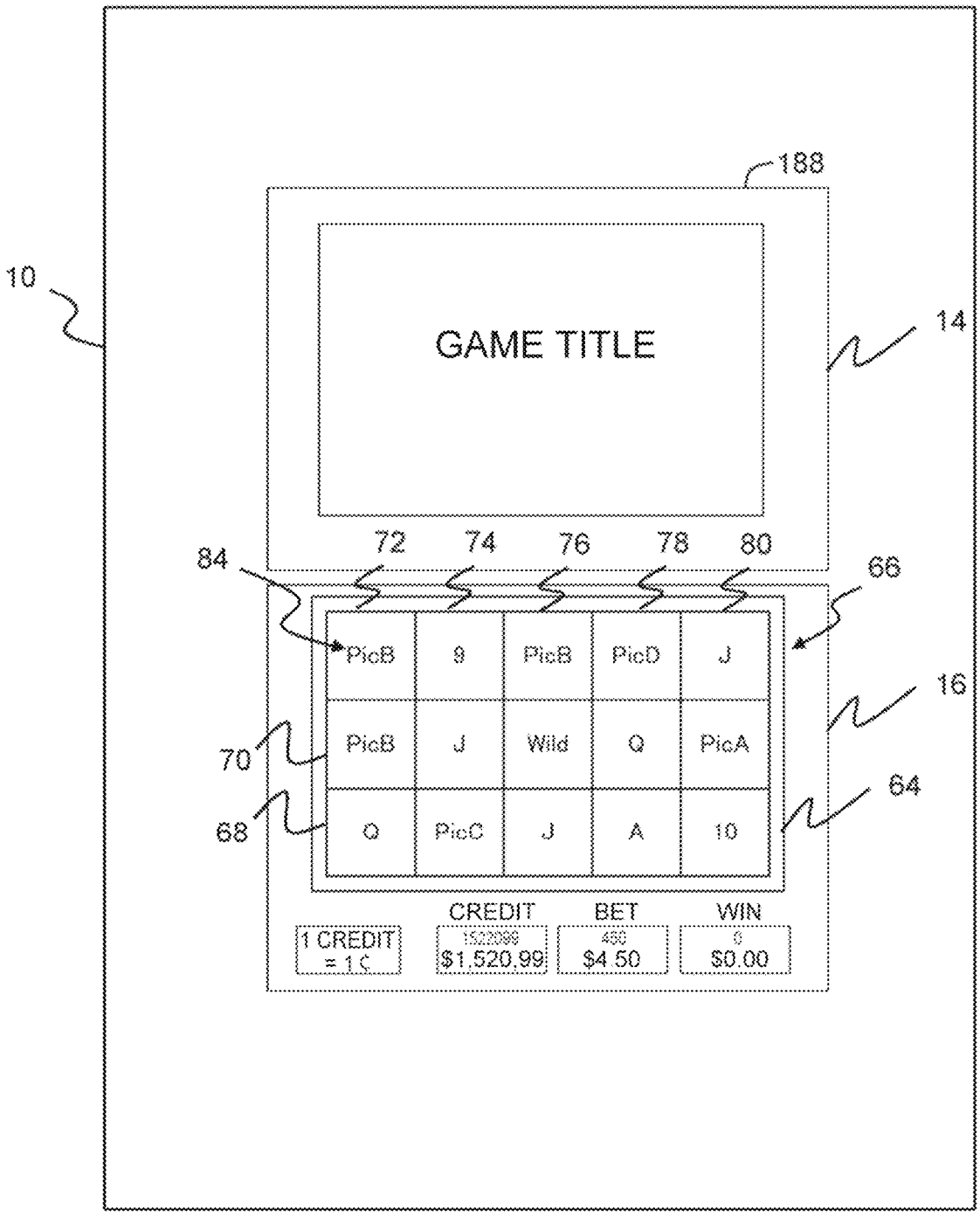
FIG. 3 is a schematic diagram illustrating an example of a game screen of the gaming machine of FIG. 2.

The interface unit 40 includes various types of communication interfaces for communicating with the outside of the gaming machine 10. As an example, the interface unit 40 can communicate with an external network via the Ethernets 58 and 60 and the serial interface 62. FIG. 3 illustrates an example of performing communication with each of a well-known server-side gaming network (server-based gaming), G2S network (between game systems), and a slot information system (a slot data system).

FIG. 3 is a schematic diagram illustrating an example of the game screen of the gaming machine of FIG. 2. As illustrated in FIG. 3, a game screen having a display area 64 that displays a slot game is displayed on the lower display 16 by the controller 22 executing a predetermined program. The display area 64 is displayed in an area below the game screen as an example. An effect such as information related to a game and an animation is displayed on the game screen other than the display area 64.

The display area 64 includes a grid 68 for displaying symbols. By using such a display area, the gaming machine 10 operates as a slot machine that performs winning determination in accordance with a combination of symbols displayed in the display area 64 and pays a dividend.

The lower display 16 displays a plurality of symbols on the grid 68. The grid 68 includes a plurality of rows and a plurality of columns. The grid 68 is configured with a plurality of cells 70 which are symbol stop positions. FIG. 3 illustrates a game screen with a plurality of cells arranged in a form of a 3×5 grid. The number of rows or the number of columns in the grid is not particularly limited and may be 3-4-4-4-3. One symbol is stopped and displayed on each of the plurality of cells 70 in the display area 64.

Figure 4:
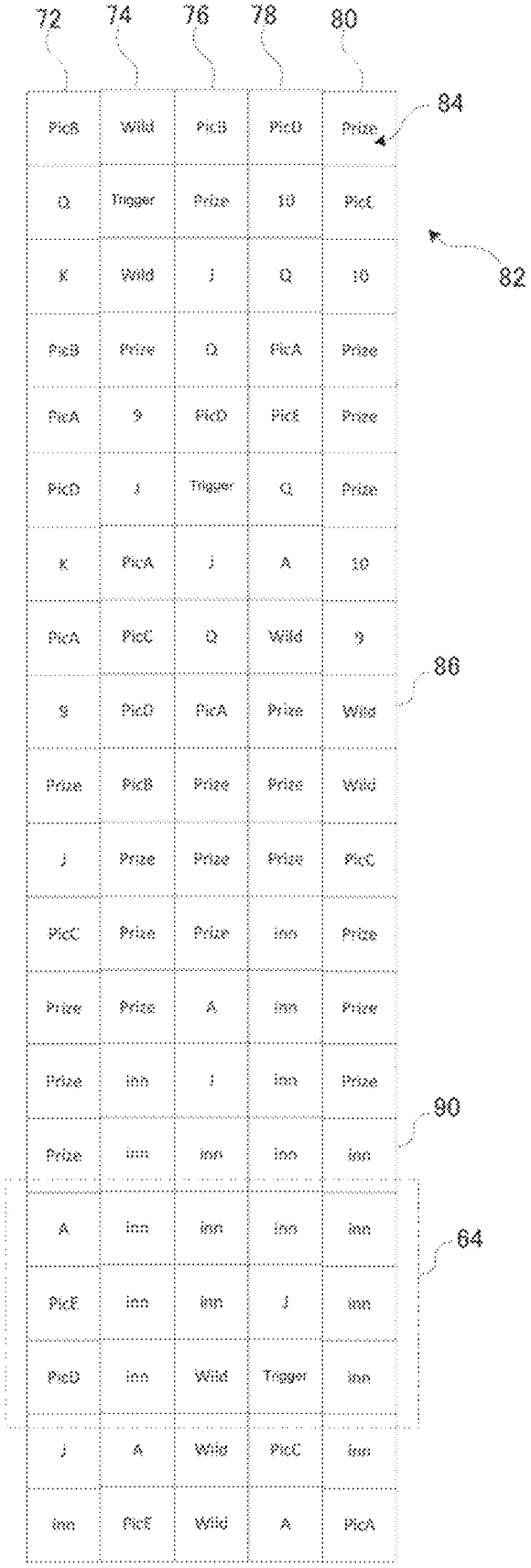
FIG. 4 is a diagram illustrating an example of a virtual reel strip including a symbol array indicating an order of symbols displayed in a display area.

The symbol arranged in each of the plurality of cells 70 is determined using a virtual reel strip. FIG. 4 is a diagram illustrating an example of a virtual reel strip including a symbol array indicating an order of the symbols displayed in the display area. As illustrated in FIG. 4, a symbol is displayed in each cell 70 of the grid 68 on the basis of a symbol array of a virtual reel 66 including virtual reel strips 72, 74, 76, 78, and 80 forming a virtual reel set 82. In other words, the cells 70 of the grid 68 are associated with the virtual reel strips 72 to 80 for each column, and the symbols arranged in predetermined portions of the virtual reel strips 72 to 80 are displayed. Further, as the respective symbols in each column are moved (scrolled or spun) on the basis of the symbol arrays of the virtual reel strip 72 to 80, the symbols displayed on the cells 70 of the grid 68 are changed, and the movement (scroll or spin) of each column is stopped, so that the symbols are stopped. Here, the virtual reel strips 72 to 80 are data, and the controller 22 uses a program included in the memory 42 or the storage 44 and data for displaying the symbol array adjusted for each cell column (that is, an alignment sequence of the symbols on each reel strip). Further, the virtual reel set 82 is a general term for the virtual reel strips 72 to 80. Further, a plurality of virtual reel sets may be prepared in accordance with game content. For example, a virtual reel set used in a primary game may be distinct from a virtual reel set used in a bonus game or a free game.

Figure 5:
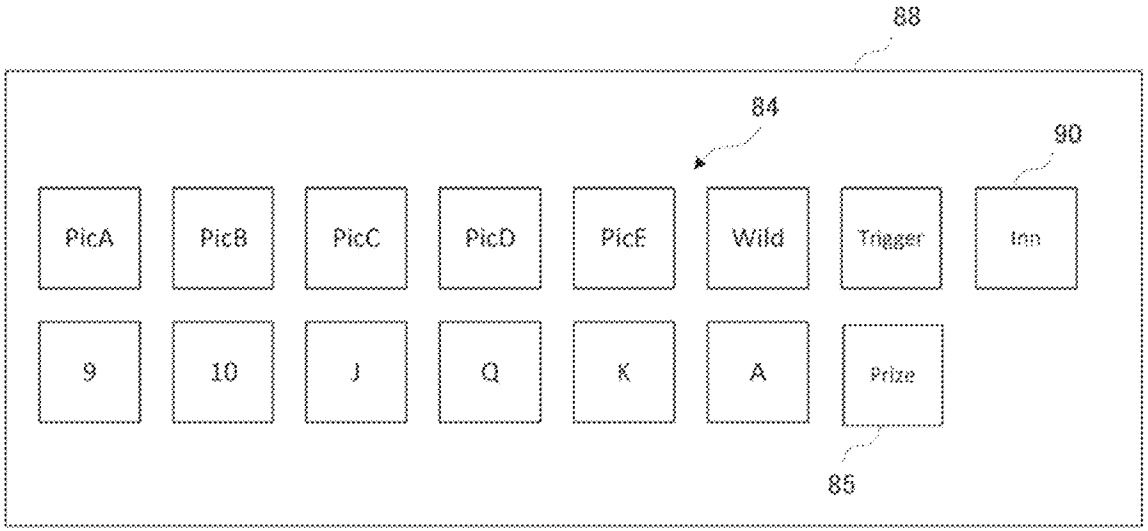
FIG. 5 is a diagram illustrating an example of a symbol displayed in a display area.

Each of the virtual reel strips 72 to 80 may include 20 symbols 84 in each symbol position 86, and these symbols are arranged in the order defined for each reel. FIG. 5 illustrates the symbols 84 illustrated in FIG. 4 in detail. Each of the virtual reel strips 72 to 80 includes symbols selected from the symbol set 88 of various types of symbol 84 illustrated in FIG. 4. The symbol set 88 includes card symbols ("9," "10," "J," "Q," "K," and "A") imitating a trap as standard symbols and image symbols ("PicA," "PicB," "Pic,C," "PicD", and "PicE") representing patterns. Further, the symbol set 88 includes a wild symbol ("Wild") used as another symbol when a winning combination is determined and a trigger symbol ("Trigger") used for determining whether or not a game feature is provided. These symbols have different ranks for their values at the time of winning, and their ranks gradually increase in the order of "9," "10," "J," "Q," "K," "A," "PicE," "PicD," "PicC," "PicB," and "PicA." A combination of symbols including a symbol with a high rank at the time of winning can win a larger winning dividend than a combination of symbols with a low rank at the time of winning. The virtual reel set 82 further includes a plurality of credit winning symbols 85 ("Prize"). Each of the credit winning symbols 85 represents various credit amounts that can be given to the player during the game. Various types of credit amounts may include a credit number randomly selected from 10, 15, 20, 30, 60, 150, 350, 700, 1000, 1500, and 3000 credits for each game. Each credit number may be multiplied by a line-by-line bet at the start of each spin. In addition to the credit amount, the credit winning symbol may indicate a progressive bonus and/or a bonus game trigger that can be given to the player during the game.

Returning to FIG. 4, in one embodiment, some symbol positions may include fixed symbols, and the other symbol positions may include variable symbols represented by variable symbols 90 ("inn"). In an exemplary embodiment, for each game play, a fixed symbol position includes an associated predetermined symbol from a set of symbols 84, and the variable symbol 90 includes a symbol randomly selected from the symbol set 88.

The controller 22 starts the game and randomly determines the stop position of each of the virtual reel strips 72 to 80. The virtual reel strips 72 to 80 displayed on the lower display 16 move from the current position, stop on the basis of the stop position, and represent the result of the game. For this reason, in the lower display 16 or the grid 68, the symbols included in the virtual reel strips 72 to 80 are continuously moved (scrolled or spun) in the vertical direction of the display area 64, and one symbol of one cell 70 aligned in the symbol order on the basis of symbol array is stopped and displayed.

The controller 22 may vary and stop a plurality of symbols to be displayed on the lower display 16 in accordance with the operation of the player received by the operation unit 32, and the dividend may be paid in accordance with the symbols stopped in the display area 64.

Figure 6:
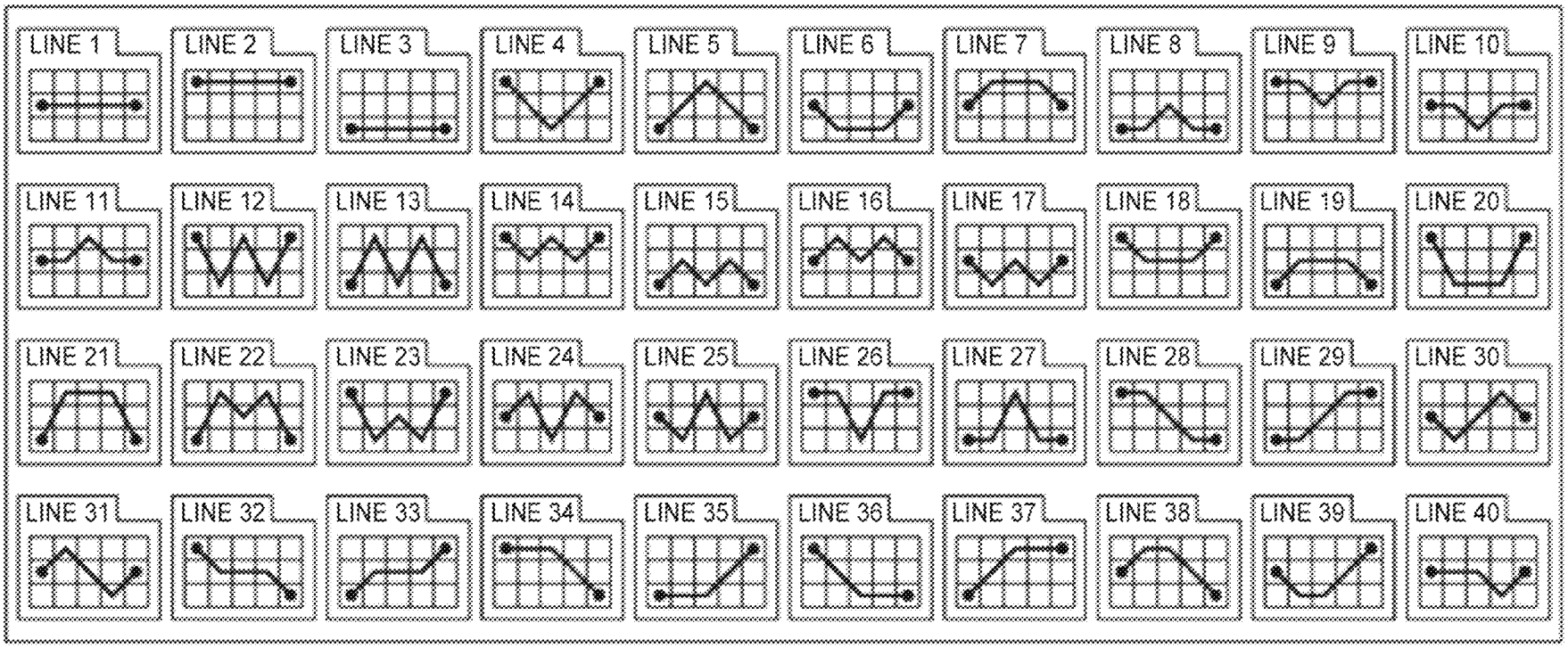
FIG. 6 is a diagram illustrating an example of a payline set in a display area of FIG. 3.

In the display area 64, a payline is set and used when winning is determined. The payline is a line which is set to extend from the cells in the leftmost column to the cells in the rightmost column and is used to determine winning in accordance with a combination of the plurality of cells 70. The number of effective lines in the set payline is selected by operating a group of line designation buttons included in a group of setting buttons of the operation unit 32 for the player. The controller 22 determines winning when the same symbols exceeding a predetermined number are aligned on the set payline as the result of the game that is a combination of symbols, and pays the dividend to the player in accordance with a type of symbol and the number of symbols. FIG. 6 is a diagram illustrating an example of the payline set in the display area 64 of FIG. 3. As illustrated in FIG. 6, in the gaming machine 10, a predetermined number of paylines (40 pattern lines) can be set in cells of 3 rows and 5 columns in the display area 64. A system for determining winning may determine winning when a predetermined number of same symbols are aligned from the cells in the leftmost column on the set payline, may determine winning when a predetermined number of same symbols are aligned from the cells in the rightmost column on the set payline, or may determine winning when a predetermined number of same symbols are aligned in consecutive columns on the set payline. Further, "Triggers" which are more than a predetermined number form a winning combination or a trigger condition regardless of the payline.

Figure 7:
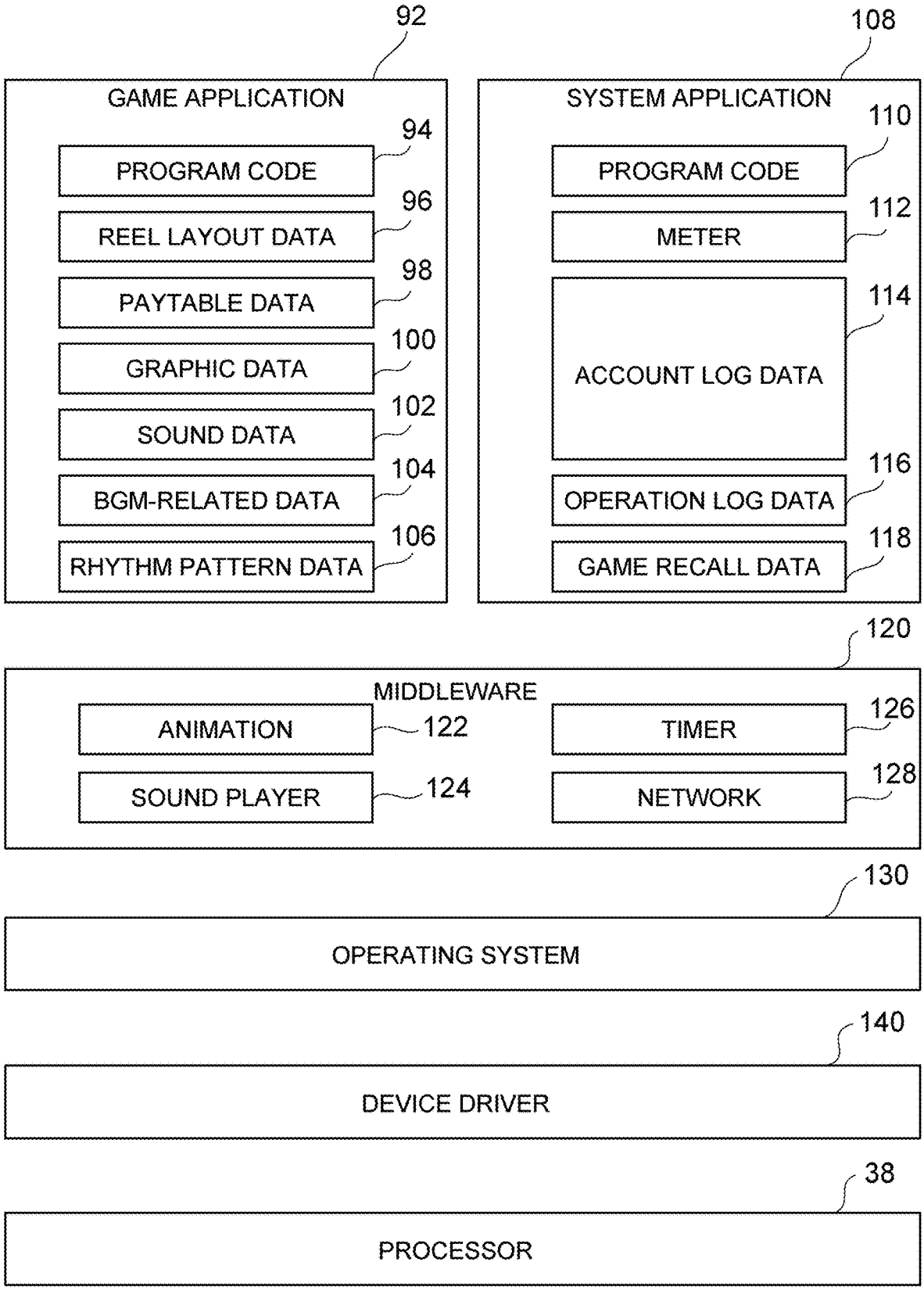
FIG. 7 is a block diagram illustrating an example of software and data of a gaming machine.

FIG. 7 is a block diagram illustrating an example of software and data of the gaming machine. The gaming machine 10 includes a game application 92 and a system application 108. The game application 92 and the system application 108 are stored, for example, in the memory 42. The game application 92 and the system application 108 are programs and include program codes 94 and 110 which are examples of computer executable commands. When executed by the processor 38, the program codes 94 and 110 cause the processor 38 to generate the game and the lower display 16 of the gaming machine 10 to display it. When executed by the processor 38, the game application 92 provides a game-dedicated/front-end function, and the system application 108 provides a general-purpose/back-end function.

The game application 92 and the system application 108 are implemented on the same operating system 130. These applications may be implemented on different operating systems or may be implemented by different processors.

The game application 92 includes data used when providing the game-dedicated/front-end function. As an example, the game application 92 includes reel layout data 96, paytable data 98, graphic data 100, sound data 102, BGM-related data 104, and rhythm pattern data 106.

The reel layout data 96 is data including the virtual reel strip, and includes the virtual reel set 82 illustrated in FIG. 4 as an example. The paytable data 98 is a table in which a winning combination is associated with winning. The graphic data 100 is graphic data to be displayed on the upper display 14 and the lower display 16. The graphic data 100 includes data for generating animation data for events. Examples of the event include a reel stop according to the operation of the player, a triggered bonus feature, and a randomly generated bonus feature.

The sound data 102 can be audio waveform data. The sound data 102 includes sound data of the BGM and event sound data. The sound data of the BGM is data of song that is reproduced as background music when the gaming machine 10 provides a game to the player. For example, the gaming machine 10 may be configured to start reproduction of the sound data of the BGM when it becomes a game executable state, continue the reproduction while the game is being provided, and end when it becomes a game non-executable state. More specifically, the gaming machine 10 may start the reproduction of the sound data of the BGM from a time point at which the game value is input into the gaming machine 10. Further, the gaming machine 10 may continue the reproduction of the sound data of the BGM until the player consumes all of the game value or until the player pays out the game value. In a case in which the gaming machine 10 provides a plurality of BGMs, the sound data 102 may include sound data for a plurality of songs.

Here, the sound data of BGM may include sound data of an intro part that is the beginning of a track and sound data of a repeat part in which a melody is repeated. In this case, a sound is output using the sound data of the intro part at the start of the song, and the sound data of the repeat part is loop-reproduced after the sound data of the intro part ends. The event sound data is a song, a sound effect, or the like output when an event occurs. For example, a sound effect when the reel is stopped, a sound effect while the reel is spinning, a song reproduced at the time of winning, a song reproduced at the time of big prize winning, a sound effect, a song reproduced when paying out the game value, or the like can be used as the event sound data.

The BGM-related data 104 includes tempo data for the sound data of the BGM. The tempo data is data describing timing information of a tempo or beat of the entire BGM (an example of beat information). If the controller 22 that executes a predetermined program code reproduces the sound data of the BGM, a BGM song is output from the speaker 26 in accordance with the tempo of the tempo data or so that the beat is kept at a timing described in the tempo data. The tempo data may include information of a loop start point and a loop end point for the loop reproduction described above.

FIG. 8 illustrates an example of data that is an original form of the BGM-related data 104. Such data may be output from a tool such as sequence software that generates the sound data of the BGM or may be configured by another method. As illustrated in FIG. 8, the BGM-related data 104 is tempo data including a plurality of beats 1040 associated with timings, and each beat 1040 is associated with timing information 1041. That is, the first beat 1040 is associated with the timing information 1041 of "00:00:00:000," that is, 0 milliseconds. The next beat 1040 is associated with the timing information 1041 of "00:00:00:250," that is, 250 milliseconds. Similarly, it is indicated that the beat is kept at 6000 milliseconds, 6250 milliseconds, 6500 milliseconds, 48000 milliseconds, 48250 milliseconds, and 48500 milliseconds. In other words, in this tempo data, beats are kept at intervals of 250 milliseconds in an interval from 0 milliseconds to 48500 milliseconds.

As illustrated in FIG. 8, the BGM-related data 104 may include setting data 1042 associated with each beat 1040. The setting data 1042 is associated with the beat information and settings S1 to S3. The beat information is information indicating the position of the song on the score. The largest unit of beat information is a bar, the bar is divided into beats, and the beat is divided into ticks. The tick is the minimum unit of the beat information in the sequence software, and one beat is 480 or 960. The setting S1 is a beat setting serving as the loop start point or loop end point. The setting S1 indicates that the beat associated with a start code "[" is the beat of the loop start point. The beat associated with the end code "]" as the setting S1 indicates the beat of the loop end point. In the example illustrated in FIG. 8, a beat of 6500 milliseconds is associated with the start code. For this reason, the loop reproduction starts at a beat of 6500 milliseconds (a second beat of a 4th bar). Also, a beat of 48500 milliseconds is associated with the end code. For this reason, the loop reproduction ends at a beat of 48500 milliseconds (a second beat of a 25th bar). When the loop reproduction ends, the sound data is output again from the beat of the loop start point. The setting S2 is the intensity of a sound, and the setting S3 is a length of the sound.

Figure 9:
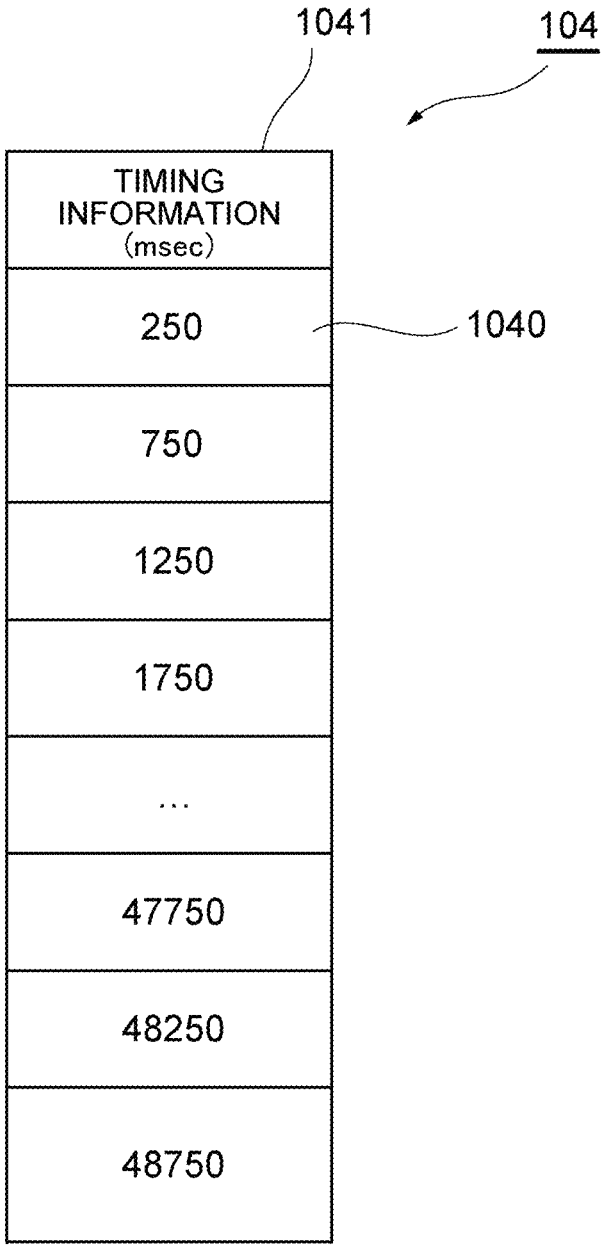
FIG. 9 is an example of converted tempo data.

The BGM-related data 104 illustrated in FIG. 8 may be converted into various data formats. Further, the setting data 1042 may not be set for each beat 1040, but one piece of data may be set for the tempo data that is the whole beats 1040. FIG. 9 is an example of the converted tempo data, and FIG. 10 is an example of the setting data 1042 associated with the tempo data of FIG. 9. The setting data 1042 illustrated in FIG. 10 is associated with the beat 1040 illustrated in FIG. 9. As illustrated in FIG. 10, the setting data 1042 includes a total of the number of beats, the timing information of the loop start position, a count of accumulated beats of the loop start position, and the timing information of the BGM end position. If the controller 22 that executes a predetermined program code reproduces sound data of the BGM, the BGM song is output from the speaker 26 so that the loop reproduction is started from the loop start position illustrated in FIG. 10 in accordance with the tempo of FIG. 9. The BGM-related data 104 illustrated in FIG. 8 may be converted into a data format illustrated in FIG. 9 in a runtime environment. Further, in FIGS. 8 and 9, a number indicated in units of milliseconds is illustrated as the timing information 1041, but the unit of the timing information 1041 may be converted into a frame count value of a frame displayed at that time from a point of view for synchronizing the animation with the BGM as will be described later.

In a case in which the gaming machine 10 provides a plurality of BGMs, the BGM-related data 104 may include tempo data associated with each piece of sound data of the BGM. In this case, in order to identify a plurality of pieces of tempo data, each piece of tempo data may be associated with an identifier identifying the BGM. A plurality of pieces of tempo data may be configured to include data in a form in which they are included in one file or may be configured as a separate file for each BGM.

Figure 11:
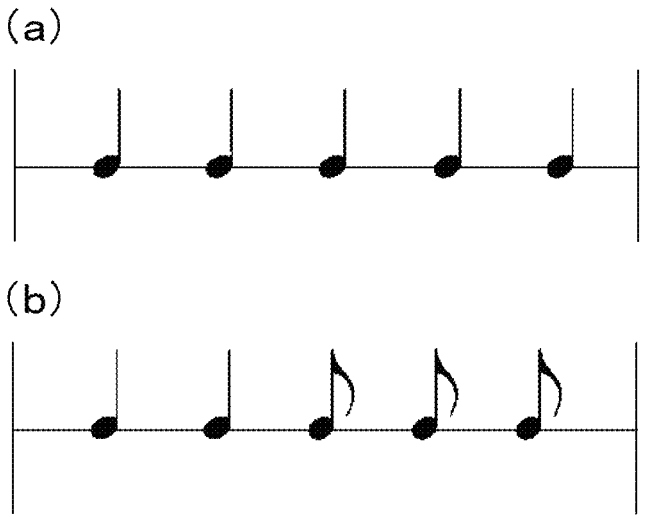
FIG. 11 is a diagram illustrating an example of rhythm pattern data expressed as a sequence of notes.

Returning to FIG. 7, the rhythm pattern data 106 includes information related to a timing sequence in which the event is executed or generated. The rhythm pattern data 106 is a regularity of a rhythm of a predetermined period. The rhythm pattern data 106 may include one rhythm pattern that is commonly applied to all events or may include a plurality of rhythm patterns to be used differently for each event. FIG. 11 illustrates an example of the rhythm pattern data 106 expressed as a sequence of notes. Since the rhythm pattern data 106 illustrated in FIG. 11(*a*) includes five consecutive quarter notes, timings at which an event is executed or generated are first, second, third, fourth, and fifth beats. Further, since the rhythm pattern data 106 illustrated in FIG. 11(*b*) includes two consecutive quarter notes and three quaver notes, timings at which an event is executed or generated are a first beat, a second beat, a third beat, a third back-beat, and a fourth beat. A data format of the rhythm pattern data 106 is not particularly limited, and a desired data format can be used.

The system application 108 includes a meter 112, account log data 114, operation log data 116, game recall data 118. The meter 112 includes a credit meter to indicate a current credit balance of the gaming machine 10 and a winning meter to indicate a total of the number of winnings in a current game session. The meter 112 further includes a background meter such as a coin input, a coin return, a total drop, a jackpot paid by a customer service, and/or a bill input. These meters may be implemented as data on a non-volatile memory or as a hardware meter. The account log data 114 is cumulative data including an error event, a bill log, a cash withdrawal log, a ticket log, or the like. The operation log data 116 is log data of the gaming machine 10. The game recall data 118 is cumulative data including bonus results of a primary game and a free game. The game recall data 118 can be stored in a non-volatile memory.

The game application 92 and the system application 108 can be implemented on the same operating system 130. However, these applications may be implemented on different operating systems or on different processors.

Middleware 120 may be used to implement the game application 92 and the system application 108 in the operating system 130. In the configuration illustrated in FIG. 7, the middleware 120 uses software modules of an animation 122, a sound player 124, a timer 126, and a network 128. The animation 122 is a software module used when generating an animation of computer graphics. The sound player 124 is a software module used when reproducing a sound. The timer 126 is a software module that manages a timer. The network 128 is a software module used when communicating with other gaming machines 10 and the like.

A device driver 140 can be used to enable the operating system 130 to recognize and use devices installed in the gaming machine 10 or externally attached to the gaming machine 10. The device driver 140 may be installed in the operating system 130 or may be externally attached to the operating system 130.

The game application 92 and the system application 108 are not limited to the above-described program and data and may include additional programs and data to implement arbitrary functions such as execution and management of games.

Figure 12:
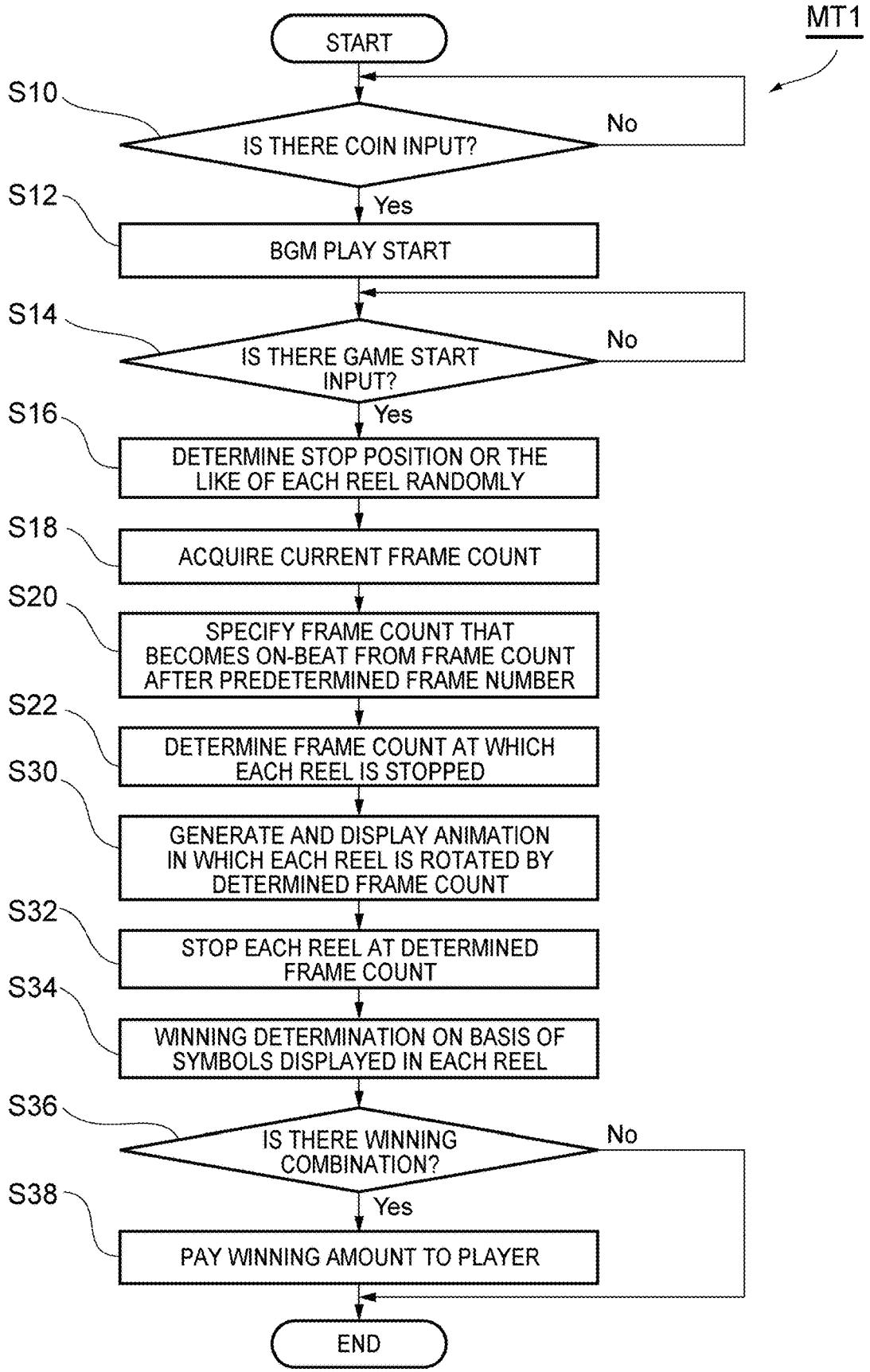
FIG. 12 is a flowchart describing an algorithm (a method MT1) used during a gaming machine operation.

FIG. 12 is a flowchart describing an algorithm (a method MT1) used during the gaming machine operation. The method MT1 (an example of a control method) illustrated in FIG. 12 is executed when the controller 22 executes the game application 92. An example of a provided game is a video slot game.

As illustrated in FIG. 12, the controller 22 determines the presence or absence of a coin input (step S10). Here, the coin input indicates that a bill, a coin, a voucher, a coupon, or the like is inserted into the gaming machine 10, and includes causing money or credit information recorded in a mobile terminal, a card, or an online account to be transferred to the gaming machine 10. The controller 22 typically determines the presence or absence of a coin input via the bill/ticket identification unit 28. In a case in which the controller 22 does not detect the coin input, the determination of step S10 is repeated. In a case in which the controller 22 detects the coin input, the reproduction of the BGM sound data is started on the basis of the sound data 102 and the BGM-related data 104, and the BGM is output from the speaker 26 (step S12). In a case in which the BGM sound data is started, the timer 126 starts measuring an elapsed time from the start of the reproduction of the BGM sound data.

Then, the controller 22 determines the presence or absence of a game start input (step S14). The controller 22 determines the presence or absence of the game start input by the player via the operation unit 32 and the input controller 52. As an example, the controller 22 determines the presence or absence of the game start input using the player's operation of pressing a spin button as the game start input. In a case in which there is no game start input, the controller 22 repeats the determination of step S14. In a case in which there is a game start input, the controller 22 randomly determines a stop position of each reel (step S16). The controller 22 determines the stop position of each reel on the basis of a random number generated by a random number generator. The controller 22 may determine not only the stop position of each reel but also the presence or absence of a feature or a bonus event to be applied on the basis of the random number generated by the random number generator.

Then, the controller 22 acquires a current BGM frame count (step S18). The controller 22 acquires the BGM current frame count via the timer 126. The current frame count is a number indicating the number of frames elapsed since the BGM starts the reproduction. For example, in a case in which the frame rate is 60 FPSs, when 3900 milliseconds elapses since the BGM starts the reproduction, the current frame count is "234 (=60*3900/1000)."

Then, the controller 22 specifies a first frame count which becomes an on-beat from the frame count after a predetermined frame number from the current frame count (step S20). The controller 22 selects a frame count of a timing at which the BGM becomes an on-beat with reference to the tempo data of the BGM-related data 104. For example, in a case in which the frame count at which the BGM is an on-beat is consecutive to "45," "75," "105," "135," "165," "195," "225," "255," . . . , when the current frame count is "65," and a predetermined frame number is "60," "135" which is a count value after "125" obtained by adding the predetermined frame number to the current frame count and is a value closest to "125" is specified as the first frame count at which the BGM becomes an on-beat.

Then, the controller 22 determines a frame count for stopping each reel (step S22). As an example, the controller 22 makes a decision to stop a first reel at the frame count specified in step S20, a second reel at the frame count 165 which becomes an on-beat at the next beat, a third reel at the frame count 195 which becomes an on-beat at the next beat, a fourth reel at the frame count 225 which becomes an on-beat at the next beat, and a fifth reel at the frame count 255 which becomes an on-beat at the next beat.

Then, the controller 22 generates spin and stop animations of each reel and causes them to be displayed (step S30). The controller 22 generates an animation in which the reel is spun until the frame count for stopping the reel determined in step S22 and stopped at the stop position determined in S16 using the graphic data 100 and the animation 122 which is a software module related to the middleware 120. At this time, for example, the controller 22 may modify the length of the reel displayed to spin in accordance with the quantity of frames used in the animation of each reel. Accordingly, it is possible to generate the animation in which it is stopped at a predetermined stop position at a predetermined timing without changing the spin speed. For example, the length of the reel is modified by omitting the display of the middle part of the reel. The controller 22 generates the reel spin and stop animations using the modified reel so that the symbols determined in the determined frame count are stopped. The controller 22 causes the generated animation to be displayed on the lower display 16.

Then, the controller 22 causes each reel to be stopped at the determined frame count (step S32). This step is performed as the controller 22 reproduces the animation generated in step S30, and each reel is stopped at the determined frame count. Here, since the timing at which the reel is stopped is set in the frame at which the BGM becomes an on-beat, the reel is stopped in accordance with the beat of the BGM, and a time lag between the timing at which the reel is stopped and the timing at which the BGM becomes an on-beat does not occur.

Then, the controller 22 makes winning determination on the basis of the symbols displayed in each reel (step S34). The controller 22 compares the symbol combination in the display area displayed on the lower display 16 with the winning combination. The controller 22 determines the presence or absence of winning on the basis of a comparison result.

In a case in which there is a winning combination in step S34, the payment is performed (step S36). The controller 22 pays a winning amount to the player in accordance with the winning combination (step S38). On the other hand, in a case in which there is no winning combination in step S34, the controller 22 ends the process illustrated in FIG. 12.

As the process illustrated in FIG. 12 is executed as described above, the display timing of the reel stop (an example of an event) can be synchronized with the beat of the BGM.

Figure 13:
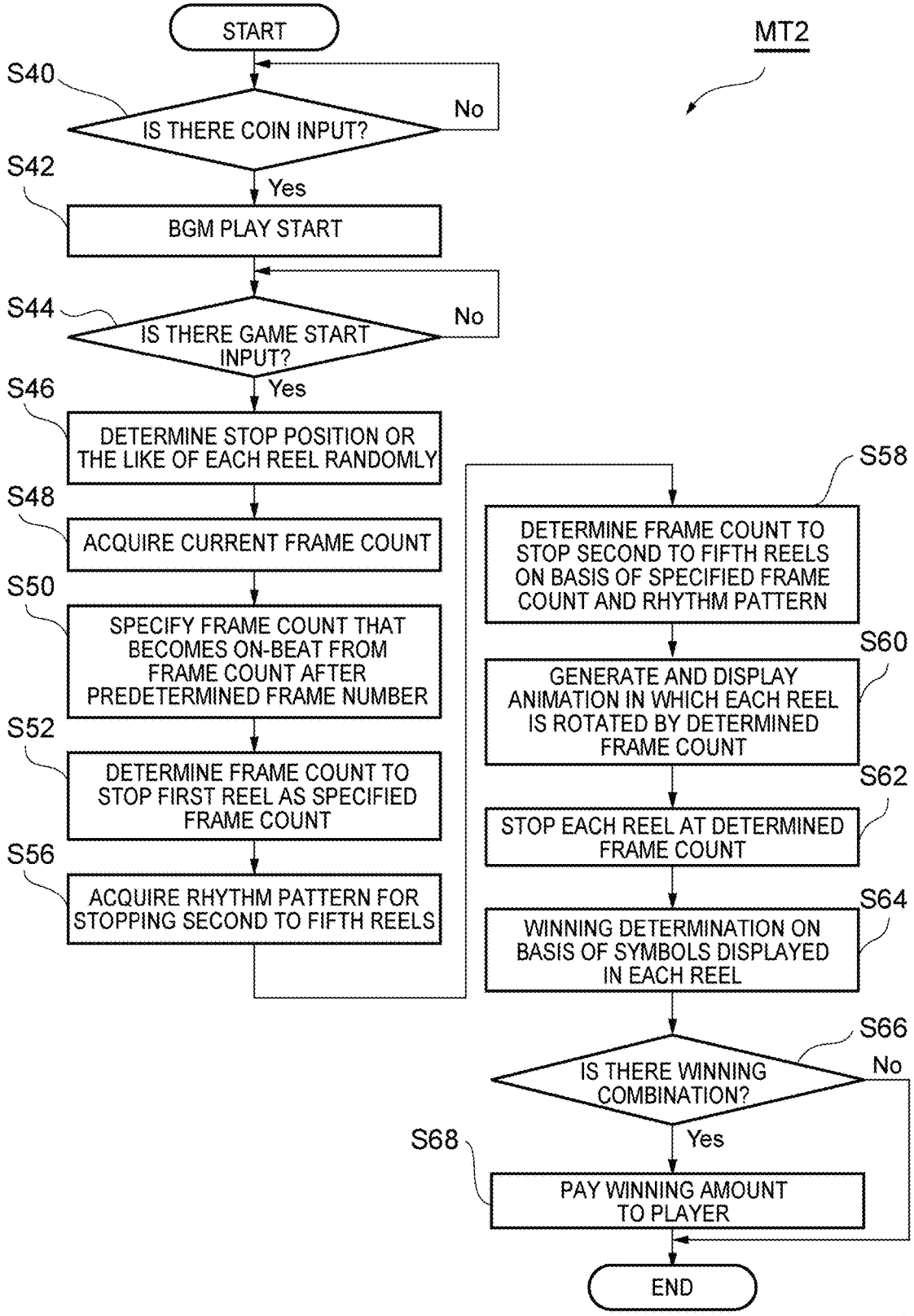
FIG. 13 is a flowchart describing an algorithm (a method MT2) used during a gaming machine operation.
Figure 14:
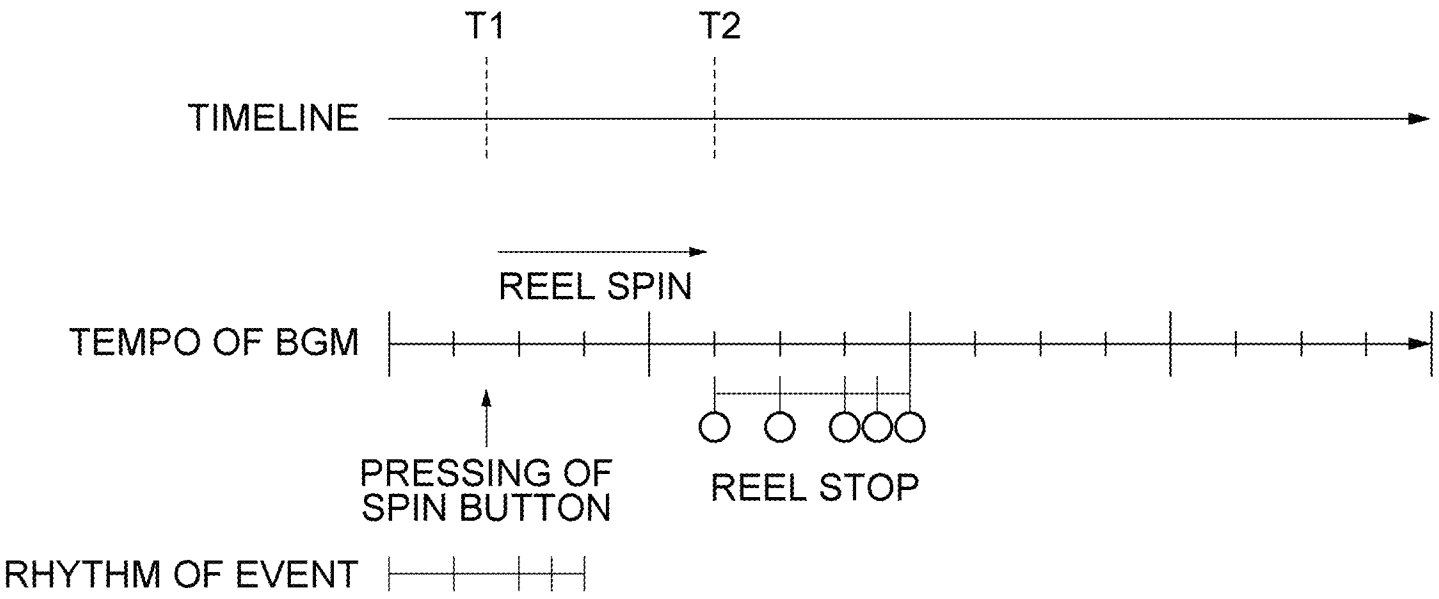
FIG. 14 is a diagram describing an example of a reel stop sound according to a tempo of a BGM.

FIG. 13 is a flowchart describing an algorithm (a method MT2) used during the gaming machine operation. The method MT2 (an example of the control method) illustrated in FIG. 13 is executed when the controller 22 executes the game application 92. An example of the provided game is a video slot game. The method MT2 will be described with reference to FIG. 14. FIG. 14 is a diagram describing an example of a reel stop sound according to the beat of the BGM.

A process from step S40 to step S50 is the same as the process from step S10 to step S20 of FIG. 12. In the processes described above, as illustrated in FIG. 14, at a time T1 at which the spin button is pressed, the game start input is determined (step S44), and a frame count (corresponding to a time T2) that initially becomes an on-beat from the frame count after a predetermined frame number is determined (step S50).

After the frame count that initially becomes an on-beat is specified, the controller 22 determines a frame count to stop the first reel (the virtual reel strip 72) (step S52). The controller 22 determines the frame count (corresponding to the time T2) specified in step S50 as the frame count to stop the first reel.

Then, the controller 22 acquires a rhythm pattern for stopping the second reel (the virtual reel strip 74) to the fifth reel (the virtual reel strip 80) (step S56). The controller 22 acquires the rhythm pattern of the reel stop event with reference to the rhythm pattern data 106. For example, as illustrated in FIG. 14, the rhythm pattern illustrated in FIG. 11(*b*) is acquired corresponding to each reel.

Then, the controller 22 determines the frame count to stop the second to fifth reels on the basis of the frame count (corresponding to the time T2) specified in step S50 and the rhythm pattern acquired in step S56 (step S58). As illustrated in FIG. 14, the controller 22 causes the specified frame count (corresponding to the time T2) to match with the beginning of the rhythm pattern (the stop timing of the first reel) and determines the frame count at which the second to fifth reels are stopped in accordance with the rhythm pattern.

The subsequent processes of step S60 to step S68 are the same as those of step S30 to step S38 illustrated in FIG. 12, and the display of the animation, the winning determination, and the payment are performed.

As the process illustrated in FIG. 13 is executed as described above, the display timing of the reel stop (an example of an event) can be synchronized with the beat of the BGM, and the reel stop sound can be superimposed on the on-beat in the BGM.

Figure 15:
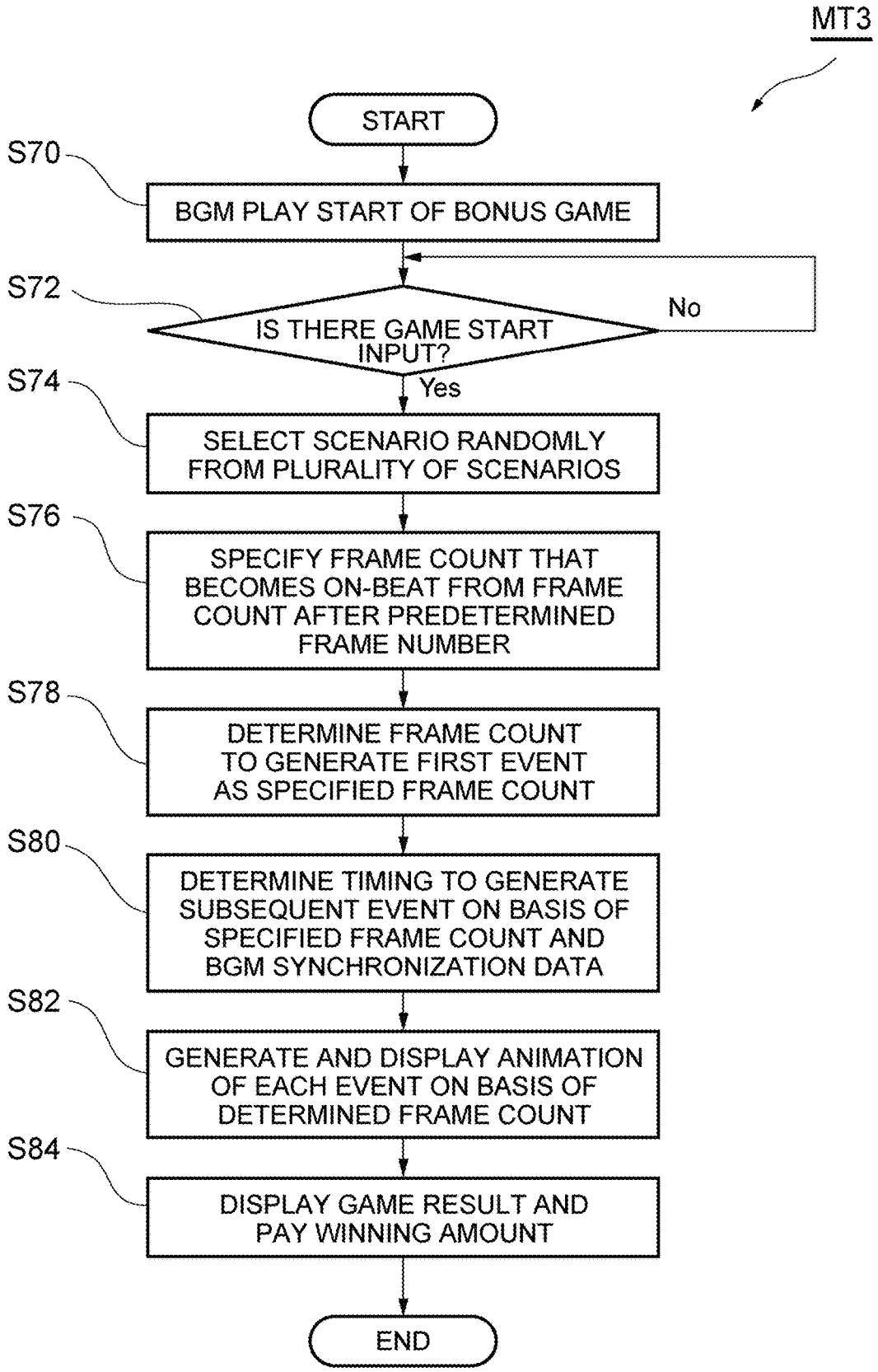
FIG. 15 is a flowchart describing an algorithm (a method MT3) used during a gaming machine operation.

FIG. 15 is a flowchart describing an algorithm (a method MT3) used during the gaming machine operation. The method MT3 (an example of the control method) illustrated in FIG. 15 is executed when the controller 22 executes the game application 92. For example, in the method MT3, the process is started when a symbol combination in the display area displayed on the lower display 16 includes a symbol combination for acquiring a bonus game in the winning determination (step S34) of FIG. 12.

As illustrated in FIG. 15, the controller 22 starts reproducing the BGM for the bonus game. The controller 22 reproduces the BGM sound data for the bonus game on the basis of the sound data 102 and the BGM-related data 104, and the BGM for the bonus game is output from the speaker 26 (step S70).

The subsequent process of step S72 is the same as the process of step S14 of FIG. 12, and the game start input is determined.

In a case in which there is a game start input, the controller 22 randomly selects a scenario from a plurality of scenarios (step S74). A scenario of the bonus game can be stored in the memory 42 in advance. The controller 22 selects one scenario from a plurality of scenarios on the basis of a random number generated by a random number generator with reference to the memory 42. A game in which an object related to a symbol displayed on the lower display 16 jumps up toward the upper display 14, and an amount corresponding to the jump height is paid as a bonus will be described below as the bonus game. The object may jump a plurality of times. In this case, a combination of a position at which the object jumps, the number of jumps, a jump height, and the like is recorded in the scenario of the bonus game.

The subsequent process of step S76 is the same as the process of step S20 of FIG. 12, and the first frame count that becomes an on-beat from the frame count after a predetermined frame number is specified.

Then, the controller 22 determines a frame count that generates a first event (step S78). As an example, the controller 22 determines the frame count specified in step S76 as the frame count that generates the first event. Accordingly, a frame count of a timing at which the object starts jumping is specified.

Then, the controller 22 determines a frame count that generates a subsequent event (step S80). The controller 22 determines the frame count that generates the subsequent event on the basis of the frame count specified in step S76 and the tempo data of the BGM-related data 104. The subsequent event may be, for example, a second jump of the object or another movement of object.

Then, the controller 22 generates an animation of the event and starts displaying it (step S82). The controller 22 generates an animation that operates on the basis of the frame counts determined in step S78 and step S80 on the basis of the graphic data 100 and the animation 122. The controller 22 displays the generated animation on the lower display 16 and the upper display 14.

Then, the controller 22 displays a game result and pays a winning amount (step S84).

As the process illustrated in FIG. 15 is executed as described above, the display timing of the bonus game (an example of an event) can be synchronized with the beat of the BGM.

As described above, according to the gaming machine 10 according to the present embodiment, the BGM is output from the speaker 26 in accordance with the player's operation, and the display of the progression of the game is started on the lower display 16. The frame count for displaying the event on the upper display 14 and/or the lower display 16 is determined on the basis of the BGM tempo data, and the animation data dynamically configured so that the event is displayed at the determined frame count is displayed on the upper display 14 and/or the lower display 16. Since the display timing of the event is determined on the basis of the BGM tempo data as described above, the display timing of the event can be synchronized with the beat of the BGM. Further, since the display timing of the event is determined on the basis of the user's operation, the display timing of the reel stop is synchronized with the beat of the BGM even in the case of the reel stop (an example of an event) that occurs in response to the user operation. Accordingly, the gaming machine 10 can provide the event in the game to the player as experience with a high degree of satisfaction.

According to the gaming machine 10 according to the present embodiment, the screen display can be synchronized with the beat of the BGM even in the bonus game (an example of an event) that occurs randomly and has a timing which is not uniquely determined. According to the gaming machine 10 according to the present embodiment, the display timing of the event can be synchronized with the event sound.

According to the gaming machine 10 according to the present embodiment, since the event sound can be output with the rhythm included in the rhythm pattern, it is possible to help the player understand easily that the event occurs even if various event sound are used. As described above, since various sounds can be used as the event sound, it is possible to give a wide range of effects using a sound.

According to the gaming machine 10 according to the present embodiment, the timing at which the spin and stop of an individual reel (an example of a plurality of events) are displayed on the upper display 14 and/or the lower display 16 is determined on the basis of the rhythm and the beat of the BGM determined by the rhythm pattern data 106, the display timing at which the spin and stop of an individual reel can be synchronized with the beat of the BGM while getting into the rhythm determined by the rhythm pattern data 106. Accordingly, it is possible to help the player easily understand a connection between a plurality of events, and it is possible to give a wider range of event expressions using sound. Since the timing of the stop operation of the reel at which the player is most interested in is synchronized with the beat of the BGM, it is possible to provide the player with a rhythmic game progression and provide a comfortable game in which the BGM is combined with the operation of the reel.

The exemplary embodiments of the gaming machine, the gaming system, and the display method have been described above in detail. The gaming machine, the system, and the method are not limited to a specific embodiment described in this specification, but rather the components of the gaming machine and/or the system and/or the steps of the method may be used individually independently of the other component and/or step described in this specification. For example, the gaming machines may be used in combination with other gaming systems and methods and are not limited to the implementation using only the gaming machine described in this specification. Rather, the exemplary embodiments may be carried out and used in connection with applications of many other gaming systems.

For example, the gaming machine 10 that provides the game in the form of a slot machine has been described in the embodiment, but the present invention is not limited thereto, and the game may be provided in the form of a video card game called a poker, a blackjack, a bingo, a keno, a wheel game, or the like. Further, the present invention can be applied to pachinko machines or pachinko slot machines.

Also, the controller in this specification is not limited to a single processor, but can include a plurality of processors. In other words, the controller may be referred to as a controller including a GPU.

Also, the event according to the present disclosure is not limited to the events described in the embodiment. For example, the controller 22 may configure animation data in which an effect is added to a display in which the reel is spinning. In other words, the effect added to the display in which the reel is spinning may be included as the event. Further, the controller 22 may light up the illumination 36 in accordance with the on-beat timing of the BGM. In other words, the lighting-up of the illumination 36 may be included as the event.

A controller, a computing device, or a computer described in this specification includes at least one or more processors or processing units and a system memory. Commonly, the controller also includes at least a certain form of computer readable medium. Examples of the computer readable medium include, but are not limited to, a computer storage medium and a communication medium. The computer storage medium may include removable and non-removable volatile and non-volatile mediums which are implemented by an arbitrary method or technique for enabling storage of information such as a computer readable command, a data structure, a program module, or other data. The communication medium typically includes an arbitrary information delivery medium that embodies a computer readable command, a data structure, a program module, or other data through a modulated data signal such as a carrier wave or other transport mechanisms. A modulated data signal having one or more characteristics set or changed so that information is encoded into a signal would be understood by those skilled in the art. The arbitrary combination is also included within the scope of the computer readable medium.

The order in which an operation is performed or executed in the embodiment of the present invention illustrated and described in this specification is not mandatory unless otherwise specified. That is, the operation described in this specification may be performed in an arbitrary order unless otherwise specified, and the embodiment of the present invention may include operations more or less than the operations disclosed in this specification. For example, it is considered to be within the scope of aspects of the present invention to perform or execute a particular operation before, simultaneously with, or after another operation.

In some embodiments, as the processor described in this specification, an arbitrary programmable system including a system and a microcontroller, a reduced instruction set circuit (RISC), an application specific integrated circuit (ASIC), a programmable logic circuit (PLC), and an arbitrary other circuit or processor capable of executing a function described in this specification is included. The above examples are illustrative only and are therefore not intended to limit the definition and/or meaning of the term "processor."

In this specification, the examples including the best mode to disclose the present invention is used, and the example including the best mode in which those skilled in the art can implement the present invention in addition to manufacturing and using an arbitrary device or system and performing an arbitrary incorporated method is used. The patentable scope of the present invention is defined by claims set forth below and may include other examples that is conceivable by those skilled in the art. Other aspects and features of the present invention can be obtained from the review of the drawings, the disclosure, and the appended claims. The present invention may be implemented by a method other than those specifically set forth in the appended claims. It should also be noted that steps and/or functions described in the appended claims are not limited to a particular order of operations regardless of an order in which steps and/or functions are described.

The specific features of various embodiments of the present invention are illustrated in some drawings and may not be illustrated in other drawings, but this is for convenience only. On the basis of the principles of the present invention, an arbitrary feature of a drawing may be referenced and/or claimed in combination with an arbitrary feature of any other drawing.

REFERENCE SIGNS LIST

10 . . . gaming machine, 14 . . . upper display, 16 . . . lower display, 22 . . . controller, 42 . . . memory, 44 . . . storage, 102 . . . sound data, 104 . . . BGM-related data, 1040 . . . beat, 106 . . . rhythm pattern data, MT1, MT2, MT3 . . . method.

The invention claimed is:

1. A gaming machine, comprising:

a display configured to display a progression of a game including at least one event;

a speaker configured to output a sound of the game;

a storage device configured to store tempo data including beat information of an entire background music (BGM) and sound data of the BGM; and a controller connected to the display, the speaker, and the storage device, wherein the controller is configured to:

display the game including a game screen displaying a plurality of reels at a predefined frame rate while causing the speaker to output the BGM on the basis of the sound data of the BGM stored in the storage device; and detect a game start input and initiate an instance of the game by:

determining a current frame count associated with the game start input based on the predefined frame rate and an elapsed time since a start of the BGM;

determining a first frame count at which the BGM is on-beat based on the current frame count, a predefined frame count, and the tempo data;

dynamically configuring animation data so that at least one reel is displayed to spin and stop at the determined first frame count; and displaying the reels spinning and stopping based on the dynamically configured animation data.

2. The gaming machine according to claim 1, further comprising, an operation unit configured to receive a player's operation, wherein the controller detects the game start input on the basis of a timing when the player operates the operation unit and the tempo data.

3. The gaming machine according to claim 1, wherein the controller determines a stop position of the at least one reel randomly.

4. The gaming machine according to claim 1, wherein the storage device stores event sound data, and the controller causes the speaker to output a sound related to the event sound data stored in the storage device at the determined first frame count.

5. The gaming machine according to claim 1, wherein the storage device stores a rhythm pattern defining a rhythm for sequentially displaying the plurality of reels, the controller is configured to:

determine timings at which the plurality of reels are displayed on the display on the basis of the tempo data and the rhythm pattern; and dynamically configure the animation data so that the plurality of reels are sequentially stopped at the determined timings.

6. The gaming machine according to claim 1, wherein the display displays a game screen including a plurality of cells arranged in a grid form, and the controller randomly determines symbols to be arranged in the plurality of cells and performs winning determination in accordance with a combination of the symbols displayed on the display.

7. The gaming machine according to claim 5, wherein the display displays a game screen including a reel corresponding to a column of a plurality of cells arranged in a grid form.

8. The gaming machine according to claim 1, further comprising, an illumination to be lighted up, and the controller causes the illumination to be lighted up at the determined first frame count.

9. A control method of a gaming machine, the gaming machine including a display configured to display a progression of a game including at least one event, a speaker configured to output a sound of the game, a storage device configured to store tempo data including beat information of an entire BGM and sound data of the BGM, and a controller connected to the display, the speaker, and the storage device, the control method comprising the controller performing the algorithm steps of:

displaying the game in the display including a game screen displaying a plurality of reels at a predefined frame rate while causing the speaker to output the BGM on the basis of the sound data of the BGM stored in the storage device; and detecting a game start input and initiate an instance of the game by:

determining a current frame count associated with the game start input based on the predefined frame rate and an elapsed time since a start of the BGM;

determining a first frame count at which the BGM is on-beat based on the current frame count, a predefined frame count, and the tempo data;

dynamically configuring animation data so that at least one reel is displayed to spin and stop at the determined first frame count; and displaying the reels spinning and stopping based on the dynamically configured animation data.

10. One or more non-transitory computer-readable storage media, having a program for operating a gaming machine embodied thereon, the gaming machine including a display configured to display a progression of a game including at least one event, a speaker configured to output a sound of the game, a storage device configured to store tempo data including beat information of an entire BGM and sound data of the BGM, and a controller connected to the display, the speaker, and the storage device, the program causing the controller to execute the algorithm steps including:

displaying the game in the display including a game screen displaying a plurality of reels at a predefined frame rate while causing the speaker to output the BGM on the basis of the sound data of the BGM stored in the storage device; and detecting a game start input and initiate an instance of the game by:

determining a current frame count associated with the game start input based on the predefined frame rate and an elapsed time since a start of the BGM;

determining a first frame count at which the BGM is on-beat based on the current frame count, a predefined frame count, and the tempo data;

dynamically configuring animation data so that at least one reel is displayed to spin and stop at the determined first frame count; and displaying the reels spinning and stopping based on the dynamically configured animation data.

11. The one or more non-transitory computer-readable storage media of claim 10, wherein the computer-executable instructions cause the controller to:

receive a player's operation via an operation unit; and detect the game start input on the basis of a timing when the player operates the operation unit and the tempo data.

12. The one or more non-transitory computer-readable storage media of claim 10, wherein the computer-executable instructions cause the controller to:

determine timings at which the plurality of reels are displayed on the display on the basis of the tempo data and a rhythm pattern defining a rhythm for sequentially displaying the plurality of reels;

dynamically configure the animation data so that the plurality of reels are sequentially stopped at the determined timings.

13. The one or more non-transitory computer-readable storage media of claim 10, wherein the computer-executable instructions cause the controller to:

display a game screen including a plurality of cells arranged in a grid form and a reel corresponding to a column of a plurality of cells arranged in a grid form;

randomly determine symbols to be arranged in the plurality of cells and perform winning determination in accordance with a combination of the symbols displayed on the display.

14. The control method according to claim 9, further comprising the controller performing the steps of:

receiving a player's operation via an operation unit; and detects the game start input on the basis of a timing when the player operates the operation unit and the tempo data.

15. The control method according to claim 9, further comprising the controller performing the steps of determining a stop position of the at least one reel randomly.

16. The control method according to claim 9, further comprising the controller performing the steps of causing the speaker to output a sound related to event sound data stored in the storage device at the determined first frame count.

17. The control method according to claim 9, further comprising the controller performing the steps of:

determining timings at which the plurality of reels are displayed on the display on the basis of the tempo data and a rhythm pattern defining a rhythm for sequentially displaying a plurality of reels;

dynamically configuring the animation data so that the plurality of reels are sequentially stopped at the determined timings.

18. The control method according to claim 9, wherein the display displays a game screen including a plurality of cells arranged in a grid form, the control method includes the controller performing the steps of randomly determining symbols to be arranged in the plurality of cells and performing winning determination in accordance with a combination of the symbols displayed on the display.

19. The control method according to claim 18, wherein the display displays a game screen including a reel corresponding to a column of a plurality of cells arranged in a grid form.

20. The control method according to claim 9, further comprising the controller performing the steps of causing an illumination unit of the gaming machine to be lighted up at the determined first frame count.

* * * * *